US008808772B2

(12) United States Patent
Lubrina et al.

(10) Patent No.: US 8,808,772 B2
(45) Date of Patent: Aug. 19, 2014

(54) METHOD FOR COOKING FOOD PRODUCTS IN AN OVEN

(75) Inventors: Yves Lubrina, Chaussenans (FR); Fabrice Laget, Arbois (FR)

(73) Assignee: Thirode Grandes Cuisines Poligy TGCP, Poligny (FR)

( * ) Notice: Subject to any disclaimer, the term of this patent is extended or adjusted under 35 U.S.C. 154(b) by 0 days.

(21) Appl. No.: 13/222,966

(22) Filed: Aug. 31, 2011

(65) Prior Publication Data

US 2012/0107460 A1 May 3, 2012

(30) Foreign Application Priority Data

Oct. 28, 2010 (FR) ..... 10 58924

(51) Int. Cl.
*A23L 1/01* (2006.01)

(52) U.S. Cl.
USPC ..... 426/231

(58) Field of Classification Search
CPC ..... A23L 1/01
USPC ..... 426/231, 510, 511, 520; 99/330, 339, 99/467, 476, 486, 516, 468; 219/385, 401, 219/391
See application file for complete search history.

(56) References Cited

U.S. PATENT DOCUMENTS 4,924,072 A 5/1990 Oslin
5,515,773 A * 5/1996 Bullard ..... 99/330
6,028,297 A 2/2000 Hamada et al.
6,784,404 B2 * 8/2004 Meyer et al. ..... 219/412
2006/0000821 A1 * 1/2006 Gerola et al. ..... 219/401

FOREIGN PATENT DOCUMENTS

CN 1202790 A 12/1998
DE 10039444 A1 2/2002
EP 2088370 A1 * 8/2009 ..... F22C 7/08

OTHER PUBLICATIONS

Search Report results for French Patent Application No. 1058924 dated May 25, 2011.

* cited by examiner

*Primary Examiner* — Steven Leff
(74) *Attorney, Agent, or Firm* — Lowe Hauptman & Ham LLP

(57) ABSTRACT

The method for cooking a food product in an oven comprising elements, the operations of which determine cooking set-points, is remarkable in that:

cooking set-points are captured for defining an associated and determined cooking mode;

the food product is located in the oven;

the cooking operation is initiated;

the operation of the elements is monitored and, should one of such elements be defective, the operation of the cooking mode associated with the oven is automatically switched to a degraded cooking mode, having at least one of its associated set-points differing from the captured set-point.

8 Claims, 1 Drawing Sheet

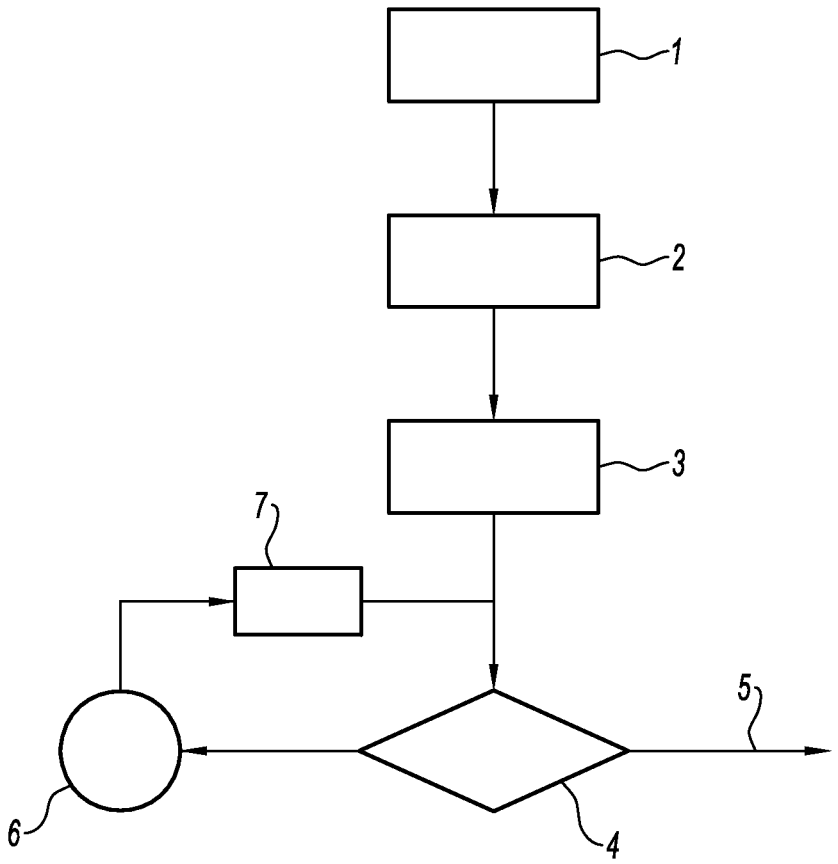
1
2
3
7
5
6
4

METHOD FOR COOKING FOOD PRODUCTS IN AN OVEN

RELATED APPLICATIONS

The present application is based on, and claims priority from, French Application Number 1058924 filed Oct. 28, 2010, the disclosure of which is hereby incorporated by reference herein in its entirety.

BACKGROUND

The present invention relates to a method for cooking food products in an oven, wherein the cooking operations could be carried out according to respectively dry (convection, pulsed hot air), wet (direct saturated vapor) or dual (dry and wet, indirect vapor) modes.

As known, amongst the priorities of users for such an oven, being an indispensable equipment item in the layout of a modern kitchen, whatever its activity (institutional catering, commercial catering, <<grand cuisine>> catering, . . . ), that relating to the reliability is of prime importance as it involves the availability of the equipment, in the present case the oven, that is a safe and reliable operation of the latter in everyday life.

However, it is also known that any technical equipment such as an oven shows limitations and the functions of the elements it is comprised of, independently from the manufacturing quality, could be defective and result in the latter standing still and in the oven becoming unavailable or being maintained only in partial operation.

In general, the elements a dual mode cooking oven comprises are essentially the muffle, defining the cooking enclosure with an associated fan and heater (electricity or gas), inside which the food product is placed, the boiler generating the vapor directed to the muffle, the electronic board module, the control button(s) and the numeric touch keypad for entering the operation set-points (cooking modes, temperatures, times, etc.).

When one of the elements of the oven shows a defective operation, or even breaks down, it could result, on the one hand, in the cooking of the food product being suddenly interrupted and, on the other hand, should such a failure extends or lead to a failure of another element, in the oven being switched off and standing still for the time period necessary for the maintenance operations.

Most of the current ovens existing on the market are provided with known solutions being quite similar between them, comprising controlling the main elements of such a dual mode cooking oven. And, most often, such controls relate to:

- the temperature of the oven, that is, that of the cooking enclosure of the muffle,
- the temperature of the vapor generating boiler,
- the presence of water in the boiler,
- the temperature of the electronic board module, etc.

The evolution of the instructions or parameters relating to such controls is, depending on the electronics being provided, commonly treated so as to display <<default messages>> which, as far as some of them are concerned, do not result in the relevant elements standing still (as long as, for example, the already abnormal temperature remains under a critical predetermined threshold), and, as far as others are concerned, result in the cooking mode, and thus, the oven being interrupted (for example, a lack of water in the vapor generating boiler stops the vapor mode cooking).

Consequently, it is understood that, not only the food product located in the enclosure is wasted as a result of the oven being stopped, but that the oven itself is stopped and stands still for a period necessary to carry out the maintenance and/or repair operations that are to be carried out so as to determine and deal with the present defect.

SUMMARY

The present invention aims at remedying these drawbacks.

To this end, the method for cooking a food product in an oven comprising elements, the operations of which determine cooking set-points, is remarkable in that:

- cooking set-points are captured for defining an associated and determined cooking mode;
- the food product is located in the oven;
- the cooking operation is initiated;
- the operation of the elements is monitored and, should one of such elements be defective, the operation of the cooking mode associated with the oven is automatically switched to a degraded cooking mode, having at least one of its associated set-points differing from the captured set-point.

Thus, the oven continues to operate without stopping, but in a degraded, limited, cooking mode, that is lower from the standpoint of the performance than the initial cooking mode, so that the food product could even so be prepared quasi-normally without being wasted, with a longer cooking time, and the oven can be consequently used further on in such a degraded mode for another food product to be cooked.

According to the method of the invention, the oven acquires the ability to recognize a defect (breakdown, failure, . . . ) and to switch to an alternative solution for maintaining some operation level of the latter, at least for a temporary period of time, until acting on and putting back in operation the defective element.

From the knowledge of the most probable defects and failures and the way to detect them, the method delivers at least as far as the defective element is concerned, a set-point different from the set-point initially entered for the relevant element, enabling to avoid blocking situations for the oven and to continue using it, with no risk, in a degraded mode.

BRIEF DESCRIPTION OF DRAWINGS

The single drawing is a flow diagram showing a method of cooking a food product according to an embodiment.

DETAILED DESCRIPTION

Examples of switching from an initial operation mode of an oven to a degraded mode, representative of the most frequent defects met by the users of the ovens, will be described hereinafter with reference to the appended flow diagram schematically illustrating the method according to this invention. This consists, according to the hereinafter steps of the flow diagram, in capturing cooking set-points for defining the selected cooking mode, with, more specifically, the temperature and the time to be programmed, reference 1, placing the food product in the oven, reference 2, initiating the cooking, reference 3, and monitoring the operation of the elements of the oven, reference 4. The following alternative results from such monitoring 4. If the elements of the oven operate normally, no defect thereof being detected, the cooking of the food product continues up to its completion, with the cooked product being removed from the oven, reference 5. On the other hand, should a defect be detected in 4 on one of the elements, the operation of the cooking mode associated with the oven is automatically switched, reference 6, for initiating a degraded mode, reference 7, having one of its set-points differing from the captured set-point. Such a degraded mode is linked to the monitoring step 4 that will analyze whether the degraded mode should be pursued until the food product is cooked in 5.

The dual mode cooking oven comprises, for example, as elements, a vapor generating boiler for the cooking mode based on saturated direct vapor supplied in the enclosure of the oven, and a system for injecting water sprayed as a mist in the direction of said enclosure, intended to the combined, dual cooking mode, through dry and indirect injection routes. Thus, when a defect of the boiler is detected in 4 and indicated by a message, for example, as a result of a lack of water supply to the boiler, of a control of a defective level leading to an overheating or a switched off or a cut or defective probe, through a set-point determined in 6, the water injection system is automatically initiated for switching from the cooking mode based on saturated vapor from the boiler to the degraded, injection cooking mode, in 7. This is then in link with 4 thus monitoring the operation thereof, the boiler, of course, being brought to a standstill. In this example, the cooking mode is thus changed.

This enables completing the cooking operation of the food product and having the oven operate despite the failure of the boiler. Thus, the oven is not stopped (blocked) and could be used subsequently in this degraded mode for the period of time necessary for carrying out the repairing operations on the boiler.

The dual mode cooking oven further comprises, as elements, in addition to the herein above mentioned ones, an electronic board module enabling to manage the different programmings. This electronic board module is housed in the oven in an enclosed space, but ventilated by air inlets of a grid located at the front and by a fan so as to be able to operate in satisfactory conditions.

However, the temperature in the enclosed space could increase as a result, for example, of the ventilation air inlets being fouled and reach a temperature threshold leading to the usual display of a message, as will be seen subsequently, informing the user to carry out a cleaning of the air inlets. The module however continues to operate normally.

However, despite such a cleaning action, the temperature in the enclosed space can continue to increase, because, amongst others, of a defective fan, of the too hot ambient air, etc., until it reaches a predetermined temperature threshold, being higher than the previous one, able to generate a dysfunction of the module and the subsequent standstill of the oven, with a specific message being displayed.

Thus, by means of the method of this invention, as soon as such a temperature threshold is reached and detected in 5, the temperature prevailing in the cooking enclosure of the muffle is decreased automatically by a determined set-point in 6, for switching from the on-going cooking mode (for example, 250° C.) to a degraded cooking mode, in 7, with a lower temperature (for example, 200° C.), thus protecting the module and in link with 4. In such an example, the on-going cooking mode is maintained and one of such parameters is decreased.

This enables completing the cooking of the food product in conditions, being indeed not optimum, but in any event, acceptable, while leaving the oven in operation. Decreasing the temperature of the cooking enclosure helps to decrease that of the enclosed space inside which the electronic board module is located, so that the latter can continue to operate normally without any overheating risk for these components. The oven is not in a blocked condition and can be optionally used for cooking other food products, while waiting to carry out maintenance operations and acting on the causes having lead to the increase in temperature in the enclosed space of the module (defective fan, too hot ambient air, etc.).

The dual mode cooking oven furthermore comprises, as elements, a touch keypad screen and at least a rotary control/setting button (referred to as a rotary encoder), from which the user captures the values of the set-points (parameters) that, depending on the selected cooking mode (dry, vapor, dual) relate, more specifically, to the temperature of the oven or to that of the medium cooked food product, to the cooking duration, the humidity rate, etc.

If the control/setting rotary encoder is defective, leading the programming values becoming impossible to be entered, an action can be taken on at least one keyboard key of the touch keypad of the screen, so as to enter them.

This enables the user to continue to completely parameter the program and thus, to operate the oven in a degraded mode (lack of button) using the touch keypad screen, for a period of time required for carrying out the maintenance operations while changing the defective encoder.

From the knowledge of the failures recorded by the users of ovens, the method consists in classifying them as a function of the importance thereof and warning the user of the occurrence of a defect by means of a specific information message being displayed on the front of the oven.

Thus, an information message, for example a green one, will warn the user of a minor defect with the need to control some points and acting on them, such as cleaning the air inlet grid of the module; an information message, for example an orange one, will warn the user of a significant defect having led to the automatic switch to a degraded mode by means of a specific set-point, according to the method of the invention, via a change of mode (lack of water supply in the boiler) or maintaining the same mode, but decreasing the operation temperature thereof (overheating of the electronic board module) and a message, for example, a red one, will warn the user of a major defect for which the oven is blocked and where switching to a degraded mode is useless.

The invention claimed is:

1. A method of cooking a food product in an oven which includes elements for operating the oven, said method comprising:

capturing cooking set-points to define a first cooking mode;

initiating a cooking operation at the first cooking mode in accordance with the captured set-points, the cooking operation including a heating operation;

monitoring the cooking operation; and when one of the elements fails to continue the heating operation of the cooking operation at the first cooking mode, automatically switching the first cooking mode to a second cooking mode where another element of the oven is operated to continue the heating operation of the cooking operation at the second cooking mode, wherein the second cooking mode has at least one of cooking set-points different from the captured cooking set-points of the first cooking mode, wherein the elements of the oven comprise a vapor generating boiler and a system for spraying water, in the first cooking mode being a direct vapor mode, the vapor generating boiler supplies saturated vapor in an enclosure of the oven, in the second cooking mode being an injection mode, the system for spraying water sprays water as a mist in said enclosure, and when the vapor generating boiler fails to operate at the direct vapor mode, the first cooking mode is automatically switched to the second cooking mode defined by the injection mode in which the system for spraying water is automatically initiated by a determined set-point of the second cooking mode.

2. A method according to claim 1, wherein, when said one of the elements fails to continue the cooking operation at the first cooking mode due to one or more defects in said element, said defects are classified according to several levels including one level for which the oven is maintained operational by a control of said elements or by switching the first cooking mode to the second cooking mode, and another level for which the operation of the oven is stopped.

3. A method according to claim 1, wherein the elements of the oven comprise a touch keypad screen and a rotary control button for capturing values of the cooking set-points which are related to at least one selected from the group consisting of a temperature of the oven, a temperature of the food product placed in the oven, and a cooking duration, and when said control button fails to capture at least one of the values of the cooking set-points for the first cooking mode, at least one keyboard key on the touch keypad screen is enabled for entry of said at least one of the values of the cooking set-points.

4. A method according to claim 1, wherein said automatically switching the first cooking mode to continue the heating operation at the second cooking mode is performed due to one or more defects in said one of the elements.

5. A method of cooking a food product in an oven which includes elements for operating the oven, said method comprising:

capturing cooking set-points to define a first cooking mode;

initiating a cooking operation at the first cooking mode in accordance with the captured set-points, the cooking operation including a heating operation;

monitoring the cooking operation; and automatically switching the first cooking mode to a second cooking mode upon anticipating that one of the elements will fail to continue the heating operation of the cooking operation of the oven at the first cooking mode, wherein another element of the oven is operated to continue the heating operation of the cooking operation at the second cooking mode, and the second cooking mode has at least one of cooking set-points different from the captured cooking set-points of the first cooking mode, wherein the elements of the oven comprise a vapor generating boiler and a system for spraying water, in the first cooking mode being a direct vapor mode, the vapor generating boiler supplies saturated vapor in an enclosure of the oven, in the second cooking mode being an injection mode, the system for spraying water sprays water as a mist in said enclosure, and when the vapor generating boiler fails to operate at the direct vapor mode, the first cooking mode is automatically switched to the second cooking mode defined by the injection mode in which the system for spraying water is automatically initiated by a determined set-point of the second cooking mode.

6. A method according to claim 5, wherein the elements of the oven comprise an electronic board module for managing the first and second cooking modes, and when the temperature increases in a space where the electronic board module is located and reaches a predetermined threshold, the first cooking mode is automatically switched to the second cooking mode in which the temperature of the oven is decreased, by a given set-point of the second cooking mode.

7. A method according to claim 5, wherein said automatically switching the first cooking mode to continue the heating operation at the second cooking mode is performed due to one or more anticipated defects in said one of the elements.

8. A method according to claim 7, wherein said defects are classified according to several levels including one level for which the oven is maintained operational by a control of said elements or by switching the first cooking mode to the second cooking mode, and another level for which the operation of the oven is stopped.

* * * * *